US006477716B2

(12) United States Patent
Blaire

(10) Patent No.: US 6,477,716 B2
(45) Date of Patent: Nov. 12, 2002

(54) EASY OPENING PANTS

(76) Inventor: Gloria Blaire, 2000 Independence Rd., Winston-Salem, NC (US) 27106

( * ) Notice: Subject to any disclaimer, the term of this patent is extended or adjusted under 35 U.S.C. 154(b) by 0 days.

(21) Appl. No.: 09/976,622

(22) Filed: Oct. 10, 2001

(65) Prior Publication Data

US 2002/0040496 A1 Apr. 11, 2002

Related U.S. Application Data

(60) Provisional application No. 60/239,221, filed on Oct. 10, 2000.

(51) Int. Cl.[7] ..... A41D 1/06
(52) U.S. Cl. ..... 2/227; 2/228
(58) Field of Search ..... 2/227, 228, 238, 2/400–408, 69, 79, 234

(56) References Cited

U.S. PATENT DOCUMENTS

| | | | | | |
|---|---|---|---|---|---|
| 1,885,527 | A | * | 11/1932 | Luft | 2/227 |
| 1,893,470 | A | * | 1/1933 | Emms | 2/227 |
| 1,896,183 | A | * | 2/1933 | Manson | 2/227 |
| 2,236,636 | A | * | 4/1941 | Young | 2/227 |
| 2,264,958 | A | * | 12/1941 | Smith | 2/227 |
| 4,578,828 | A | * | 4/1986 | Smith, Sr. et al. | 2/234 |
| 4,914,756 | A | * | 4/1990 | Grassick | 2/227 |
| 5,008,962 | A | * | 4/1991 | Smith et al. | 2/227 |
| 5,010,595 | A | * | 4/1991 | Stradley | 2/227 |
| 5,802,611 | A | * | 9/1998 | McKenzie et al. | 2/227 |
| 6,243,878 | B1 | * | 6/2001 | Khemka et al. | 2/227 |
| 6,260,209 | B1 | * | 7/2001 | St. Ange | 2/227 |

FOREIGN PATENT DOCUMENTS

| | | | | |
|---|---|---|---|---|
| CH | 241637 | * | 8/1946 | 2/227 |
| CH | 303253 | * | 11/1954 | 2/227 |
| FR | 1014844 | * | 8/1952 | 2/227 |
| FR | 1043630 | * | 6/1953 | 2/227 |
| JP | 406049701 | * | 2/1994 | 2/227 |

* cited by examiner

*Primary Examiner*—Gloria M. Hale
(74) *Attorney, Agent, or Firm*—Kilpatrick Stockton LLP

(57) ABSTRACT

Uniform pants are disclosed. The pants are particularly well suited for persons in law enforcement, the military, security, construction and the like as well as medical patients and senior citizens who desire easier access, convenience and safety when attending to their restroom needs. The pants comprise: a) a waistband; (b) two leg members extending from the waistband; (c) a continuous fastener member positioned along the inseam of the leg members, wherein the fastener member begins at a point above the bottom edge of one leg member and extends upwardly and through the crotch area and then downwardly along the second leg member and ends at a point above the bottom edge of the second leg member; and wherein the positioning of the fastener member creates an opening between the bottom edge of the inseam and the fastener member on each leg member; and (d) a separate protective shield positioned beneath the full length of the fastener member. Fastener members include zippers, snaps, buttons, hooks, and hook and loop type fasteners. The zipper is of the regular, visible or invisible type when positioned inside the pants. Additionally, the inclusion of a continuous outer flap on top of the fastener member functions to conceal the fastener member from view. This outer flap is unnecessary when an invisible type zipper is used as the fastener member.

14 Claims, 9 Drawing Sheets

EASY OPENING PANTS

CROSS REFERENCE TO RELATED APPLICATION

This application claims the benefit of U.S. Provisional Application Ser. No. 60/239,221 filed Oct. 10, 2000, which is incorporated by reference in its entirety.

BACKGROUND OF THE INVENTION

The present invention relates generally to pants that are designed to provide easy and quick access to the wearer for restroom usage. More particularly, the present invention relates to pants that are designed to provide a convenient and safe way for wearers of heavy equipment or objects, particularly weapons, to use the restroom, especially persons in law enforcement, the military, security, construction and the like.

In professions such as law enforcement, police officers are required to wear uniforms and carry standard equipment. The equipment is typically secured to the waist by means of a belt and belt loops. Such equipment typically includes a radio, weapon, ammunition clip, handcuffs, baton, and pepper spray. It is not uncommon for such equipment to weigh between ~7–10 lbs. Other professions such as the military, firefighters, security personnel, electricians, and construction workers wear uniforms and have heavy equipment or objects also attached at their waists.

The uniform pants that are currently worn by female police officers are made with a short zipper in the front of the pants. The design of these pants are not well suited for restroom purposes. Removing the heavy equipment when using the restroom is quite cumbersome for female police officers. Because of the bulkiness and heavy weight of the equipment, female officers often do the following: 1) completely detach their belt with the equipment attached and lay it somewhere inside the restroom stall; or 2) keep the belt and equipment attached to the pants, resulting in the pants and equipment resting at the feet on the floor of the restroom stall. In the latter situation, the weight of the gear can cause the equipment to slide out of the belt loops.

Both options are undesirable for the officers for several reasons. First and foremost, removing the equipment in either manner presents critical safety issues. Either option places the equipment, in particular the weapon, within reach of someone in the next stall or outside the stall. Second, when the equipment remains attached to the pants, it becomes very difficult for the officer to fasten her pants. Typically, the officer leans against a wall in the restroom stall to hold up and steady the equipment in order to fasten the pants. With either option, using the restroom is terribly difficult, time consuming, and inconvenient.

Because of the inconvenience of going to the restroom and difficulty in removing the equipment, female officers have developed health problems. Officers have tended to delay using the restroom until completion of their work shift. As a result, female officers are at a greater risk of developing urinary tract infections and even more serious medical complications related thereto. Further, these medical problems, if persisting, often lead to increased work absences.

There, thus, remains a need for a type of pants that provides safe and easy access for the wearer of heavy equipment or objects to use the restroom.

SUMMARY OF THE INVENTION

The present invention is directed to a type of pants which allows the wearer of heavy equipment or objects easy, quick, and safe access for restroom purposes. For persons in law enforcement, the military, security, construction, and the like, removal of heavy gear attached to the pants is not only inconvenient but poses safety issues, especially for females. When removed, the gear is often laid somewhere inside the restroom stall. In the alternative, the gear remains attached to the belt resulting in the pants and gear on the restroom floor. In either case, the gear can be easily taken by others.

The present invention overcomes the disadvantages of existing uniform type pants by providing a pair of pants comprising: (a) a waistband; (b) two leg members extending from the waistband; (c) a fastener member positioned along the inseam of the leg members; and (d) a protective shield positioned beneath the fastener member. The fastener member is selected from the group consisting of zippers, snaps, buttons, hooks, and hook and loop type fasteners. In a preferred embodiment, the fastener member is a zipper. The zipper is of the visible or invisible type when positioned inside the pants.

The construction of the fastener member leaves additional pant fabric extending downward beyond the fastener member on each leg member. The additional fabric creates an unfinished hem, which allows the wearer to make the necessary hem adjustments to the length of each pant leg member to suit the wearer's needs. The construction of the fastener member also creates an opening approximately several inches long formed by the space between the bottom edge of each leg member and the point at which the fastener member ends on each leg member. The opening appears triangular in shape when the fastener member is in the closed position on each leg member. The wearer has the option of keeping the opening as is or, in the alternative, the opening may be closed with a Velcro® type closure (i.e., hook and loop fastener) or any other closure means. Velcro® strips are provided with the pants and can be secured vertically near or adjacent to the edge of the opening on each pant leg member.

When in the form of a zipper, the fastener member is positioned at a point above the bottom edge of one leg member and extends upwardly and through the crotch area and downwardly along the second leg member and ends at a point above the bottom edge of the second leg member.

An additional feature is the protective shield that extends along the full length of the fastener member. The protective shield is used to prevent any rubbing or friction by the fastener member against the wearer's skin. For ease of zippering, the protective shield is tapered in the crotch area of the pants.

The pants of the present invention may be constructed of any type and weight of fabric. The fastener member is made of a heavyweight plastic or other durable material that can withstand wear. The type of zipper and the manner in which the zipper is attached in the pants are done so as to lessen the visibility of the zipper on the outside area of the pants. The outer appearance of uniform pants should not be changed and should appear professional looking. Thus, the type of zipper as well as the placement of the zipper are important in the construction of the pants of the present invention.

In yet another embodiment of the present invention, a pair of pants comprising: (a) a waistband; (b)two leg members extending from the waistband; (c) a fastener member positioned along the inseam of the leg members, wherein the fastener member is a zipper that begins at a point above the bottom edge of one leg member and extends upwardly and through the crotch area and then downwardly along the second leg member and ends at a point above the bottom edge of the second leg member; and (d) a protective shield positioned beneath the fastener member. In one embodiment, the fastener member is a zipper, which is either visible or invisible when placed in the pants.

In yet another embodiment, a pair of pants using a visible or regular type zipper is disclosed. The pants comprise: (a) a waistband; (b) two leg members extending from the waistband; (c) a fastener member positioned along the inseam of the leg members; (d) a protective shield positioned beneath the fastener member; and (e) an outer flap positioned on top of the fastener member. The outer flap functions to conceal the fastener member from view. This outer flap is unnecessary when an invisible type zipper is used as the fastener member in the pants of the present invention.

Although law enforcement officers are used as examples for discussion purposes only, the scope of the present invention is not to be construed as being limited to just this profession. Rather, the pants of the present invention may be suitable for any job which requires workers to carry on their bodies heavy equipment, weapons, and the like. Additionally, the pants of the present invention can also be worn by persons with bladder control or other medical problems, when limited motion of the wearer is desired. The pants also permits easy access to injuries that may occur from the waist down. Using the pants will prevent the injured person from being moved or moved only slightly.

These and other features, objects and advantages of the present invention will become better understood from a consideration of the following detailed description of the preferred embodiments and appended claims in conjunction with the drawings described as follows:

BRIEF DESCRIPTION OF THE DRAWINGS

While the specification concludes with claims particularly pointing out and distinctly claiming the subject matter which is regarded as forming the present invention, it is believed that the invention will be better understood from the following description which is taken in conjunction with the accompanying drawings.

DETAILED DESCRIPTION OF THE INVENTION

Figure 1:
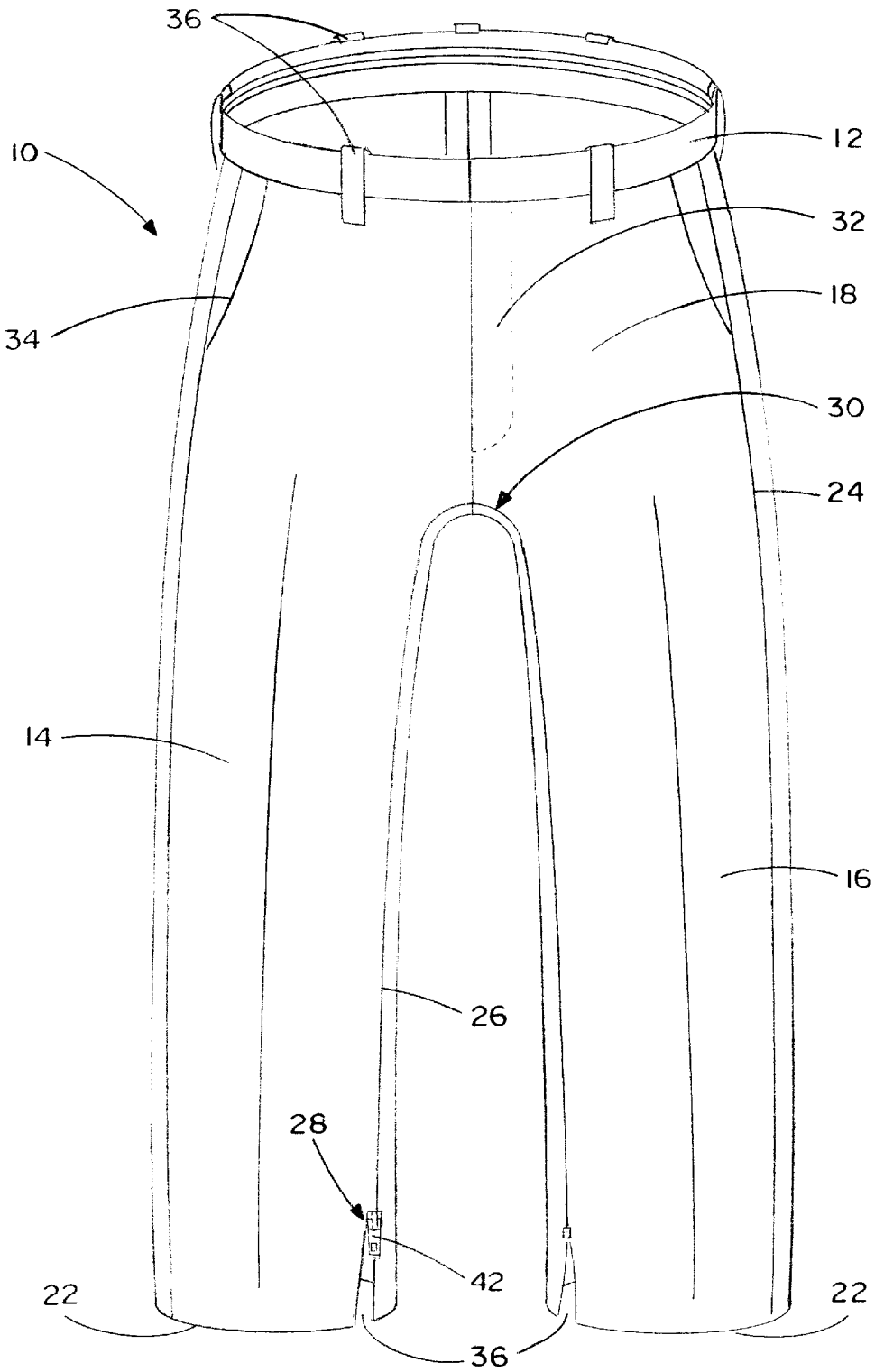
FIG. 1 is a perspective view of a pair of pants of the present invention with the fastener member (invisible zipper) in the closed position.
Figure 2:
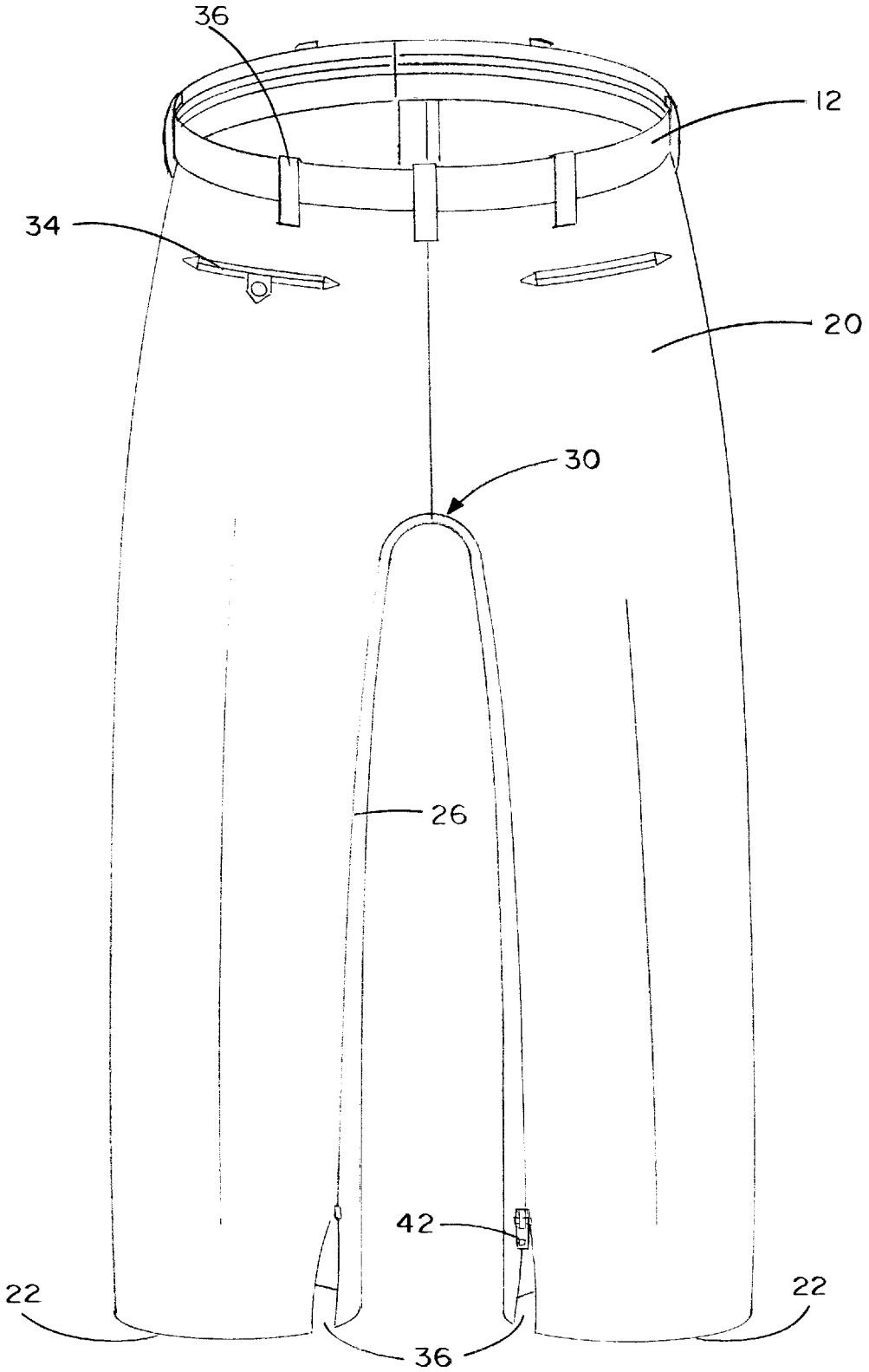
FIG. 2 is a back view of a pair of pants of the present invention.
Figure 3:
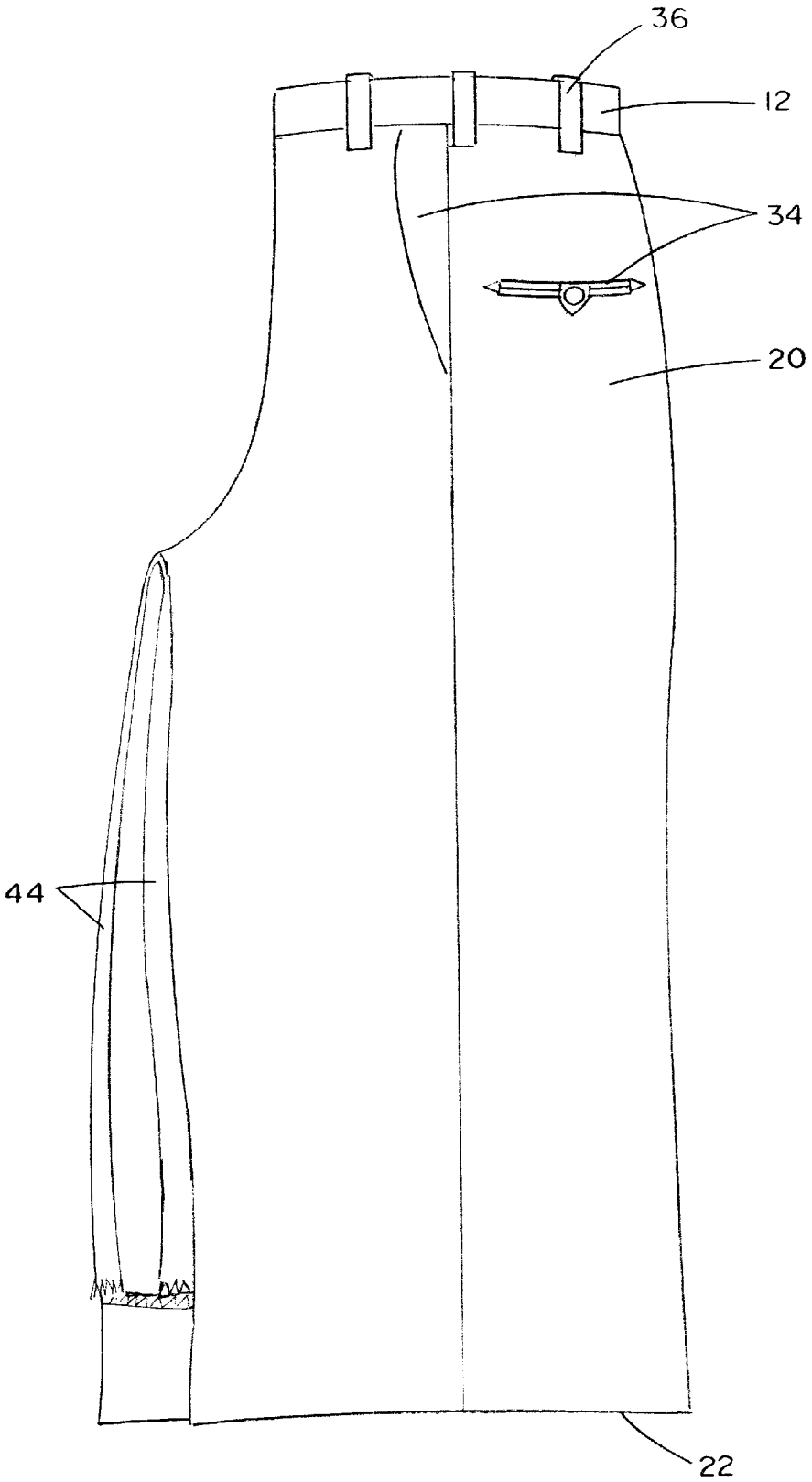
FIG. 3 is a side view of a pair of pant of the present invention.
Figure 4:
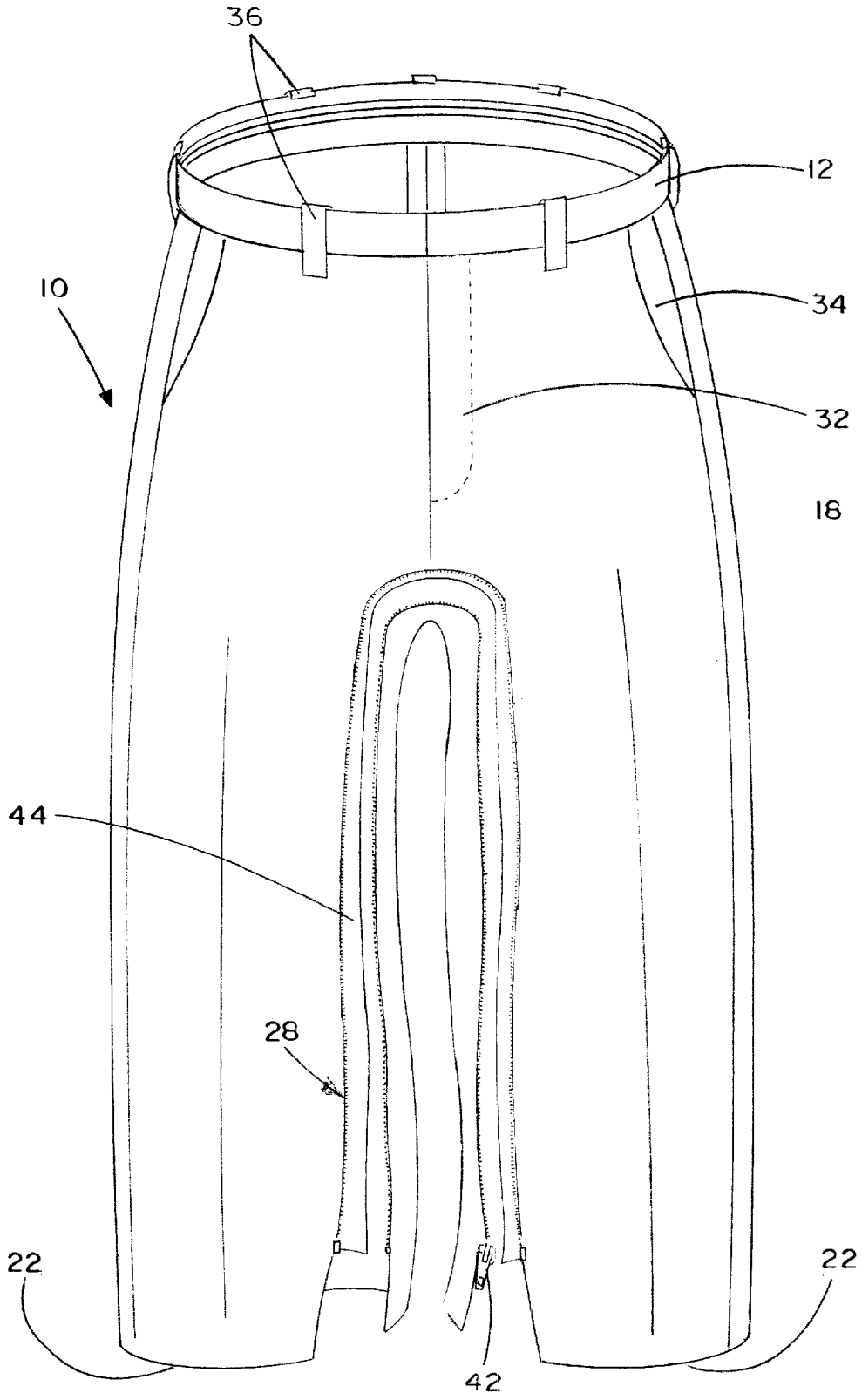
FIG. 4 is a perspective view of the pair of pants in FIG. 1 with the fastener member (invisible zipper) in the open position
Figure 5:
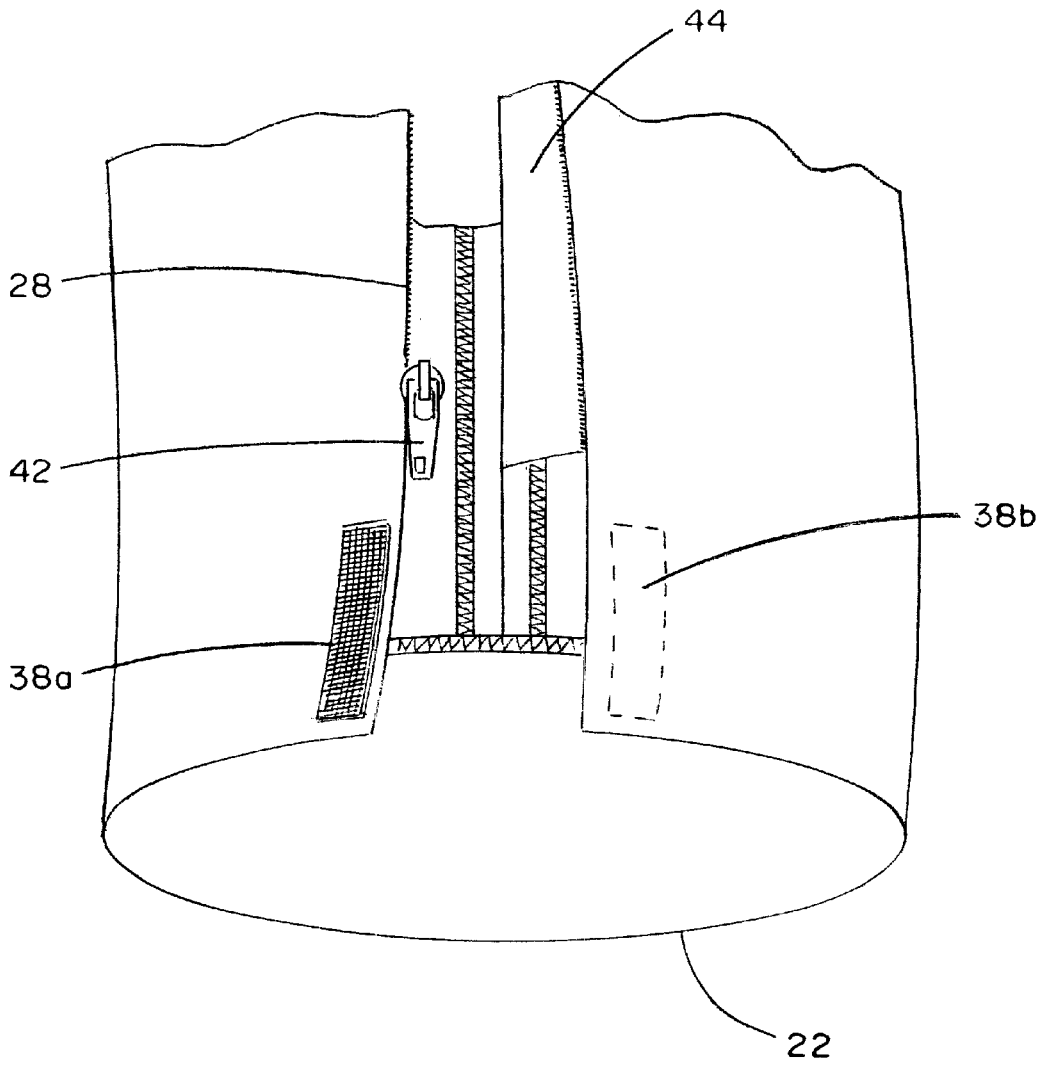
FIG. 5 is a fragmentary view of the bottom of one the pant leg members in FIG. 1 in the open position.
Figure 6:
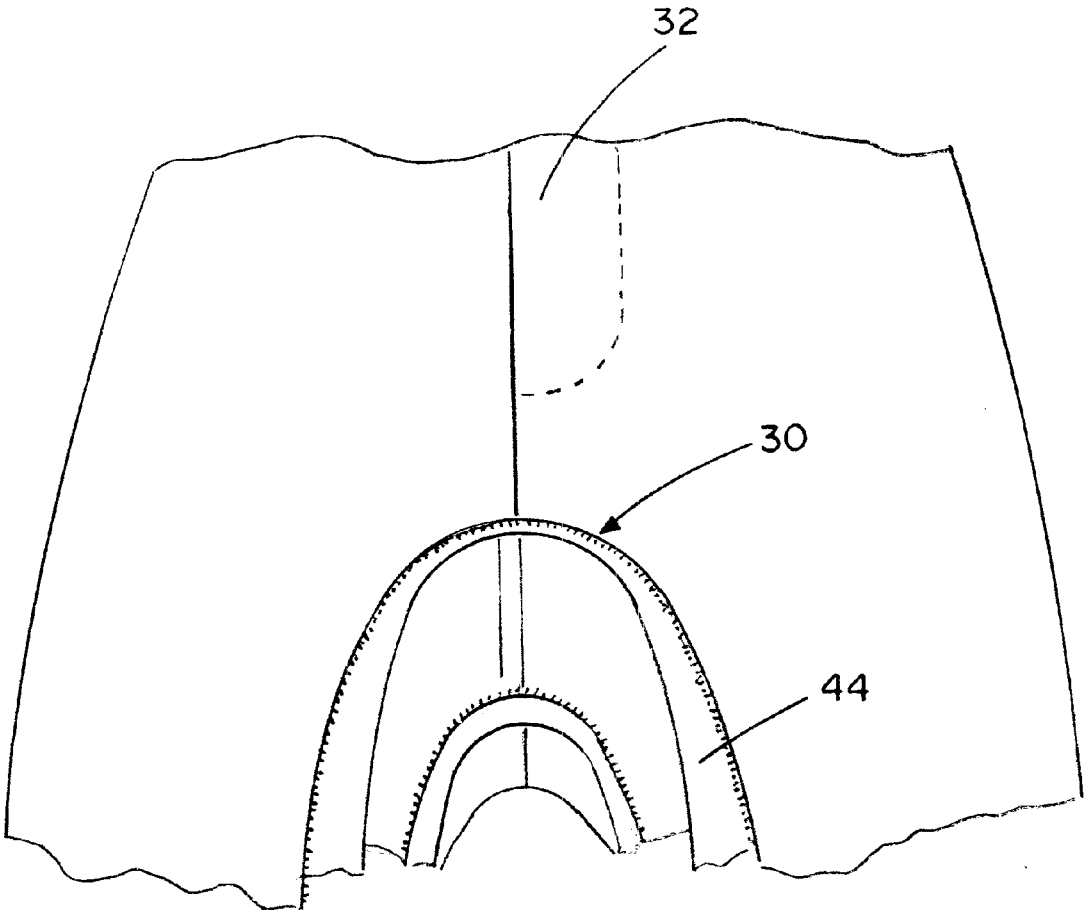
FIG. 6 is an exploded view of the crotch area of the pants of the present invention, illustrating the tapering effect of the protective shield.

Referring to FIGS. 1 through 9, the pants also known as E-Z Opener Pants™ are indicated generally at 10. The pants 10 comprise a waistband 12 and two leg members 14 and 16 extending downwardly from the waistband 12. Each leg member 14, 16 of the pants 10 is formed by a front panel 18 and a rear panel 20. These panels suitably extend from the waistband 12 to the ankle end 22 of the leg members 14 and 16. The panels 18, 20 are jointed along outer edges at outseam 24, which extends from the ankle end 22 upwardly to the waistband 12. The panels are joined along the inner edges at inseam 26 by a fastener member 28. The fastener member 28 extends along the inseam 26 of one leg member 14 upwardly through the crotch area 30 and downwardly along the inseam 26 of the other leg member 16. Further, the fastener member 28 begins at a point above the ankle end 22 of leg member 14, which is approximately 2 to about 4 inches, and ends at a point above the ankle end 22 of the other leg member 16 (roughly the same dimensions).

The pants 10 may include a front fastener member 32 and pockets 34 formed within each leg member 14, 16. The pants 10 may further include a plurality of belt loops 36 spaced apart and along the length of the waistband 12. The belt loops 36 are typically used to secure a belt that may be used to carry heavy objects or equipment.

The pants 10 are designed in different lengths (i.e., ~26 inches–44 inches) to accommodate the different heights of the wearers. For this reason, the pants 10 are constructed with an unfinished hem and the fastener member 28 does not extend to the ankle end 22 of the leg members 14, 16 as indicated above. The construction of the fastener member 28 leaves additional fabric which extends downwardly beyond the fastener member on each leg member 14, 16. The additional fabric creates an unfinished hem, which allows the wearer to make the necessary hem adjustments to the length of the pant leg members 14, 16 to suit the wearer's needs. The construction of the fastener member 28 also leaves an opening 36 approximately 2–4 inches long at the bottom edge of each pant leg member 14, 16. The wearer has the option of maintaining the opening 36 or, in the alternative, the opening 36 may be closed with a Velcro® type closure ( i.e., hook and loop fastener) or any other closure means. Velcro® strips 38*a* and 38*b* are provided with the pants and can be secured vertically near or adjacent to the edge of the opening 36 on each pant leg member 14, 16.

Fastener member 28 can be a zipper having separable halves 40*a* and 40*b*, each formed of a chain of teeth on a cloth, fabric strip, or ribbon. One half 40*a* is provided with a slide 42 including a handle for operation of the slide. The slide 42 interlockingly engages the other half 40*b*, in a manner which allows the wearer to open the pants by unzipping the zipper positioned along the inner leg seam starting near the bottom of one leg member 14 and moving upward through the crotch area 30 and downward along the other leg member to a point near the bottom of the other leg member 16. To close the pants 10, the zipper is simply moved in the opposite direction.

Laying directly beneath the fastener member 28 is a protective shield 44, which extends the full length of the fastener member 28. The protective shield 44 is made of fabric, and is designed to shield the fastener member 28, in particular zippers, from direct contact with the wearer, thereby avoiding any rubbing or friction motion to the skin area. The width of the protective shield 44 varies between about 1 inch to about 2½ inches, but is always wide enough to completely cover the fastener member 28. The width of the protective shield in the crotch area 30 is tapered so that the wearer can avoid catching the protective shield 44 in the fastener member 28.

In one embodiment of the present invention, the zipper is an invisible type zipper as referred to in the fabric industry, which means that the teeth of the zipper are directed inward on each pant leg member 14, 16. Thus, the zipper is not visible to the eye when viewing the outside of the pants 10. Essentially, only the inseam 26 is visible to the eye as shown in FIG. 1. The invisible zipper is used so that the outer appearance of the pants 10 is unchanged and remains professional looking. This is an important feature for uniform pants. Further, with the invisible zipper, there is no need to have an outer flap 46 to cover the fastening member 28 as shown in FIG. 7.

Figure 7:
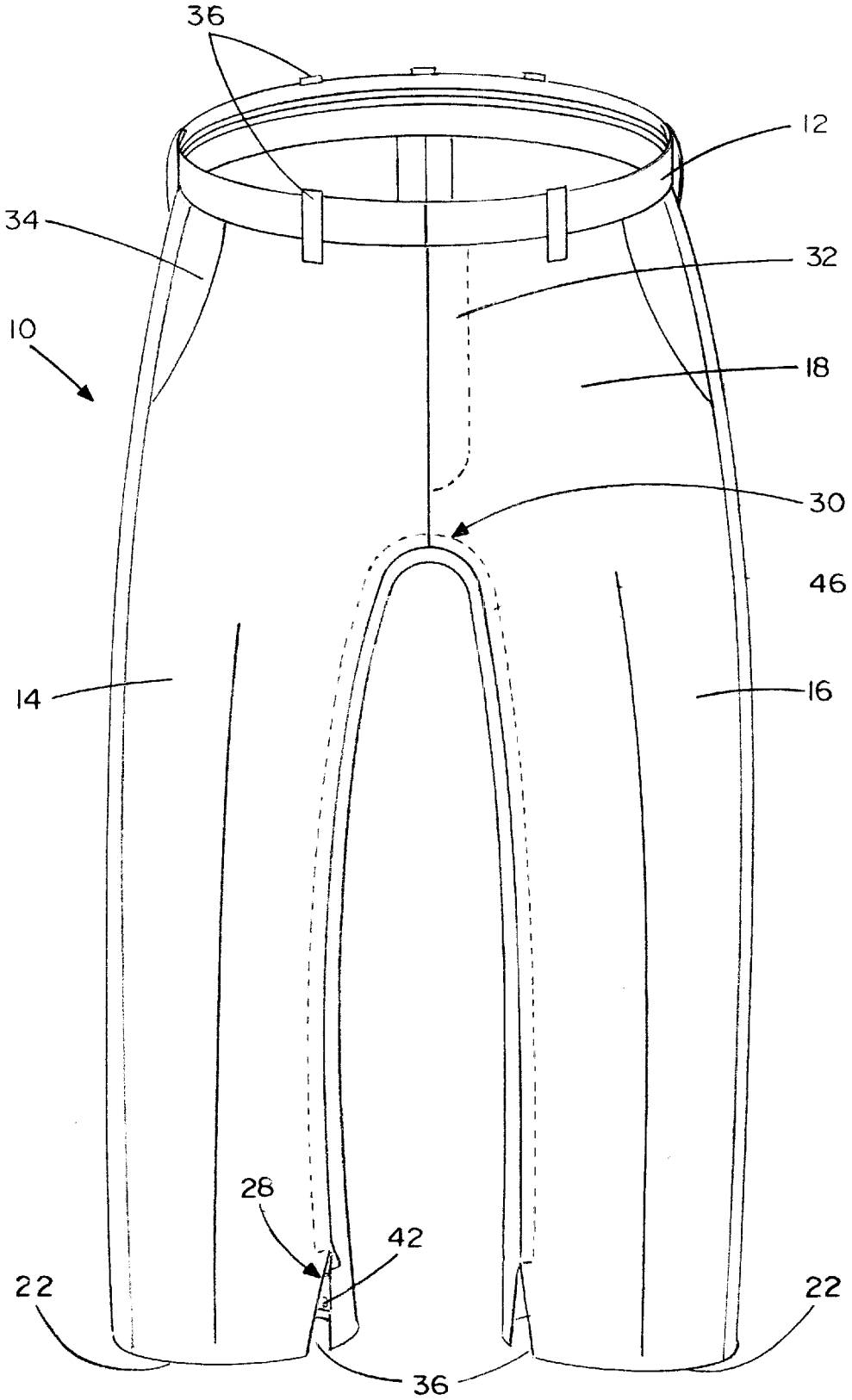
FIG. 7 is a perspective view of a pair of pants of the present invention with the fastener member (visible or regular type zipper) in the closed position.
Figure 8:
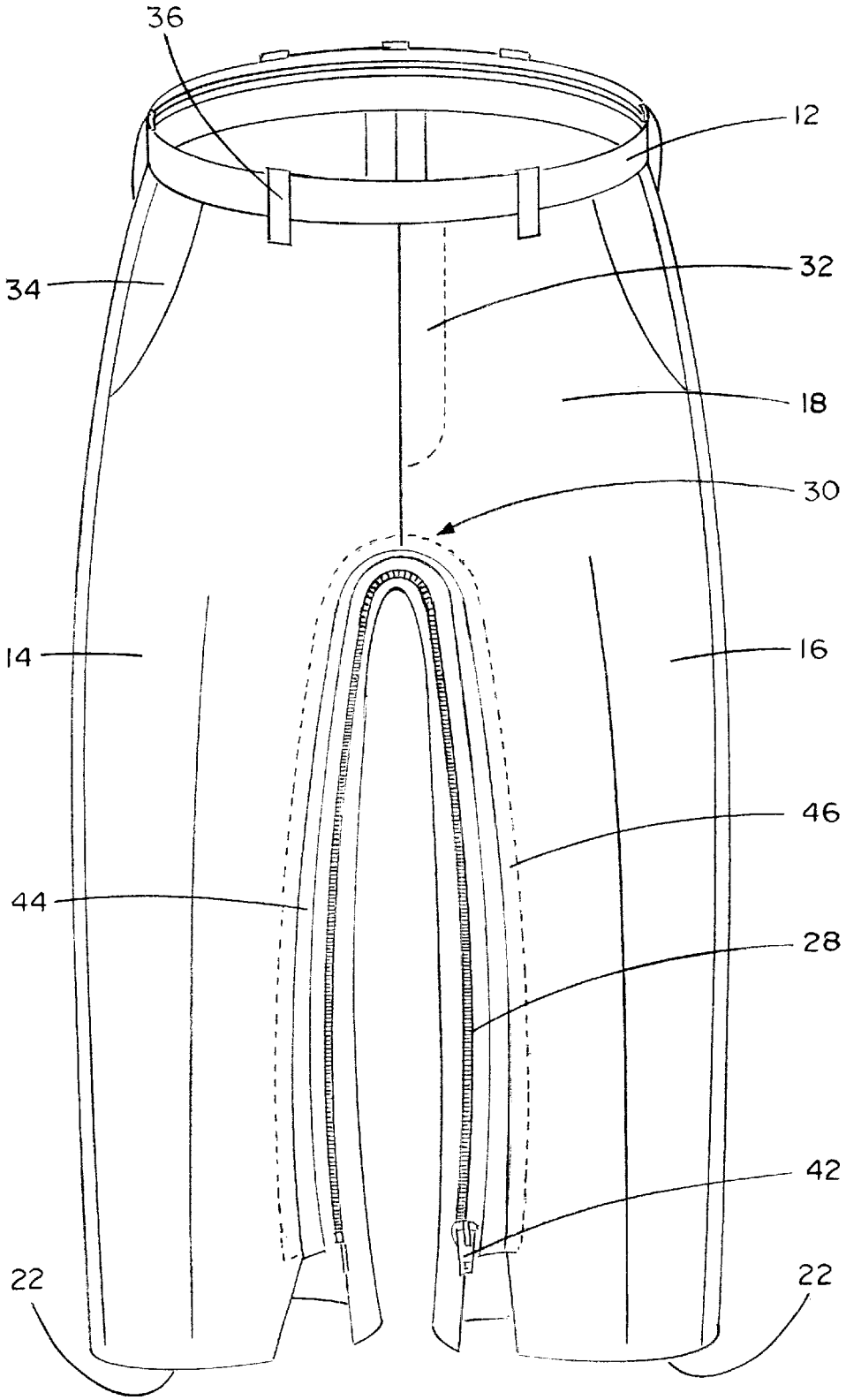
FIG. 8 is a perspective view of a pair of pants of the present invention with the fastener member (visible or regular type zipper) in the open position.
Figure 9:
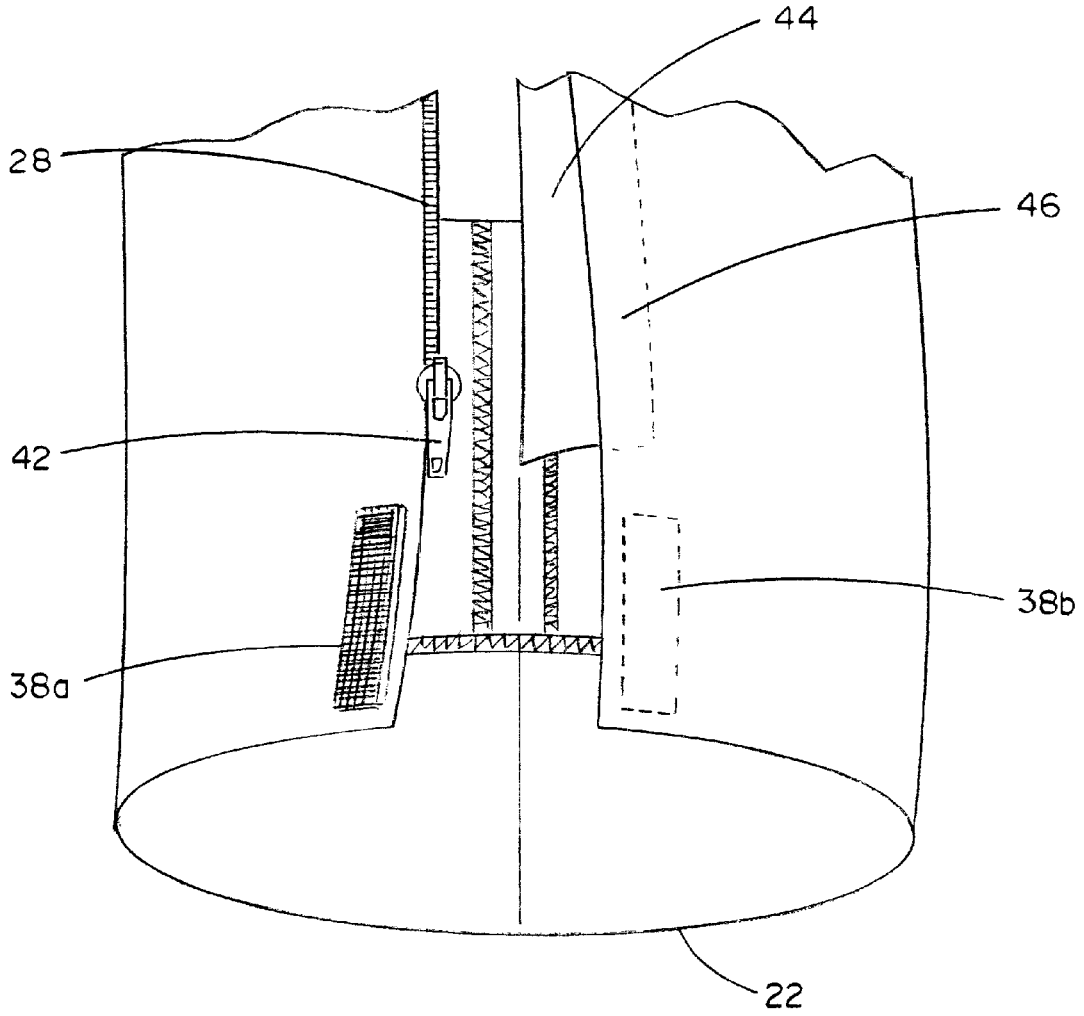
FIG. 9 is a fragmentary view of the bottom of one the pant leg members in FIG. 7 in the open position.

In an alternative embodiment of the present invention as shown in FIG. 7, a visible type zipper is used. Opposite of an invisible zipper, a zipper that is visible displays its teeth outwardly on each pant leg member 14, 16. With the construction of pants 10, the outer flap 46 is used to conceal the fastening member 28.

In another embodiment of the present invention, a waistband 12 that comprises an elastic material is used so as to provide additional room in the waist area for the wearer. This is an optional feature of the pants 10.

With the design of pants 10 and in particular the placement and operation of the fastener member 28, each of the leg members 14, 16 can be opened in a quick and easy manner to allow the wearer greater convenience when using the restroom facilities. Even more importantly, the design of the pants 10 allows the upper area of the pants 10 to remain intact so that any equipment being carried can remain attached to the wearer while the wearer uses the restroom. This feature addresses the equipment safety issues frequently faced by female law enforcement officers. Without this feature, the wearer would have to remove any equipment or objects attached at the waistband 12 by way of a belt and place it somewhere in the restroom stall or simply allow the equipment to remain attached and then rest the equipment of the restroom floor. Either of these options presents safety problem for law enforcement officers.

In another embodiment, a braid can be stitched along the outer seam of each pant leg, extending from the waistband 12 to the ankle end 22 of the leg members 14, 16.

Although the description of the invention focuses on pants of the type worn by law enforcement officers, it is contemplated within the scope of the present invention that the pants may also be worn by private security personnel, firefighters, electricians, cable workers, military personnel, hunters, construction workers, medical patients, fishermen, campers, hikers, injured persons, senior citizens and others who desire easier access, convenience and safety when attending to their restroom needs.

All references referred to herein are hereby incorporated by reference in their entirety.

It should be understood that various changes and modifications to the presently preferred embodiments described herein will be apparent to those skilled in the art. Such changes and modifications can be made without departing from the spirit and scope of the present invention and without diminishing its attendant advantages. It is therefore intended that such changes and modifications be covered by the appended claims.

I claim:

1. A pair of pants comprising:

(a) a waistband;

(b) two leg members extending from the waistband, each having an outer seam, an inseam, and a hem edge;

(c) a continuous fastener member positioned along the inseam of the leg members, wherein the fastener member begins at a point above the hem edge of one leg member and extends upwardly and through a crotch area and then downwardly along the second leg member and ends at a point above the hem edge of the second leg member; and wherein the positioning of the fastener member creates an opening between the hem edge and the fastener member on each leg member; and (d) a separate protective shield positioned below the fastener member and extends the full length of the fastener member.

2. The pants according to claim 1, wherein the opening is closed with a hook and loop type fastener.

3. The pants according to claim 1, wherein the protective shield is tapered in the crotch area of the pants.

4. A pair of pants comprising:

(a) a waistband;

(b) two leg members extending from the waistband, each having an outer seam, an inseam, and a hem edge;

(c) a continuous fastener member positioned along the inseam of the leg members, wherein the fastener member begins at a point above the hem edge of one leg member and extends upwardly and through a crotch area and then downwardly along the second leg member and ends at a point above the hem edge of the second leg member; and wherein the positioning of the fastener member creates an opening between the hem edge and the fastener member on each leg member;

(d) a separate protective shield positioned below the fastener member and extends the full length of the fastener member; and (e) a continuous outer flap positioned above the fastener member and extends the full length of the fastener member.

5. The pants according to claim 4, wherein the opening is closed with a hook and loop type fastener.

6. The pants according to claim 4, wherein the fastener member is a regular, visible type zipper.

7. The pants according to claim 4, wherein the protective shield is tapered in the crotch area of the pants.

8. A pair of uniform pants comprising:

(a) a waistband;

(b) two leg members extending from the waistband, each having an outer seam, an inseam, and a hem edge;

(c) a continuous fastener member positioned along the inseam of the leg members, wherein the fastener member begins at a point above the hem edge of one leg member and extends upwardly and through a crotch area and then downwardly along the second leg member and ends at a point above the hem edge of the second leg member; and wherein the positioning of the fastener member creates an opening between the hem edge and the fastener member on each leg member; and (d) a separate protective shield positioned below the fastener member and extends the full length of the fastener member.

9. A pair of law enforcement uniform pants comprising:

(a) a waistband;

(b) two leg members extending from the waistband, each having an outer seam, an inseam, and a hem edge;

(c) a continuous fastener member positioned along the inseam of the leg members, wherein the fastener member begins at a point above the hem edge of one leg member and extends upwardly and through a crotch area and then downwardly along the second leg member and ends at a point above the hem edge of the second leg member; and wherein the positioning of the fastener member creates an opening between the hem edge and the fastener member on each leg member;

(d) a separate protective shield positioned below the fastener member and extends the full length of the fastener member; and (e) a continuous outer flap positioned above the fastener member and extends the full length of the fastener member.

10. The pants according to claim 1, wherein the fastener member is selected from the group consisting of zippers, snaps, buttons, hooks, and hook and loop type fasteners.

11. The pants according to claim 10, wherein the fastener member is an invisible type zipper.

12. The pants according to claim 4, wherein the fastener member is selected from the group consisting of zippers, snaps, buttons, hooks, and hook and loop type fasteners.

13. The pants according to claim 11, further including a continuous outer flap positioned along the full length of the fastener member.

14. The pants according to claim 12, wherein the fastener member is selected from the group consisting of zippers, snaps, buttons, hooks, and hook and loop type fasteners.

* * * * *